United States Patent [19]

Brownbill

[11] 4,061,240

[45] Dec. 6, 1977

[54] CLOSURE CAP AND CONTAINER

[75] Inventor: Thomas Duncan Brownbill, London, England

[73] Assignee: John Dale Limited, London, England

[21] Appl. No.: 695,446

[22] Filed: June 14, 1976

[30] Foreign Application Priority Data

| | | |
|---|---|---|
| June 13, 1975 | United Kingdom | 25389/75 |
| July 4, 1975 | United Kingdom | 28289/75 |
| Aug. 13, 1975 | United Kingdom | 33745/75 |

[51] Int. Cl.[2] ..... B65D 53/00

[52] U.S. Cl. ..... 215/270; 215/344; 215/DIG. 1

[58] Field of Search ..... 215/270, 341, 344, DIG. 1

[56] References Cited

U.S. PATENT DOCUMENTS

| | | | |
|---|---|---|---|
| 3,142,402 | 7/1964 | Fox | 215/256 |
| 3,145,869 | 8/1964 | Ritzenhoff | 215/256 |
| 3,203,571 | 8/1965 | Plunkett | 215/DIG. 1 |
| 3,727,784 | 4/1973 | Sargent | 215/DIG. 1 |

FOREIGN PATENT DOCUMENTS

| | | | |
|---|---|---|---|
| 1,107,541 | 5/1961 | Germany | 215/DIG. 1 |
| 935,574 | 8/1963 | United Kingdom | 215/344 |

*Primary Examiner*—Donald E. Norton

*Attorney, Agent, or Firm*—Stevens, Davis, Miller & Mosher

[57] ABSTRACT

A closure for a container characterized by a crown and a depending skirt, retaining means provided on the skirt adapted to cooperate with corresponding means on a container to retain the closure about a neck of the container defining a dispensing opening thereof, a flexible annular sealing ring extending from an internal surface of the closure adapted to engage in sealing relationship with the container neck, a sealing ring support adapted to assist said ring into sealing engagement with the container and means for permitting pressure of the container contents to act upon the sealing ring to urge the ring into sealing engagement with the neck of the container to which the closure is applied.

6 Claims, 3 Drawing Figures

CLOSURE CAP AND CONTAINER

The present invention relates to closures and has particular reference to closures adapted to be applied to containers of the type having a dispensing opening and adapted to be used in the packaging of pressurized goods. Typical containers are glass bottles having screw threaded type closures and adapted to accommodate gasefied goods such, for example, as lemonade, tonic water, soda water and the like.

At the present time these containers are provided with generally metal closures which have a sealing wad in the cap thereof so that on application of the closure to the bottle or container, interaction of the screw thread between the closure and the container draws the closure down onto the neck of the container so that the wad engages the rim of the container neck to deform the same and to effect a seal between the wad and the container itself.

The manufacture of such articles involves the formation of the closure, the formation of the wad and then the insertion of the wad into the closure itself.

These closures have been used for many years and have proved to be satisfactory. They are, nevertheless, becoming increasingly more expensive to manufacture and in consequence there is considerable advantage in producing a closure readily formed of a plastic material.

Many attempts have been made to produce a suitable closure of plastic material but they all result in a limited degree of leakage due to the imperfect sealing between the plastic material itself and the neck of the container where the neck of the container has slight imperfections and is not completely regular in shape and form.

According to the present invention there is provided a closure for a container the contents of which are pressurized, which closure has a crown and a depending skirt, retaining means between the skirt and the container to retain the closure about a neck defining a dispensing opening of said container, a flexible annular sealing ring extending from an internal surface of the closure adapted to engage in sealing relationship with container neck, a sealing ring support adapted to urge said ring into sealing engagement with said container neck and means for permitting pressure of the contents of the container to act upon said sealing ring to urge said ring into sealing engagement with the neck of the container to which the closure is applied.

The sealing ring may be a flexible annular ring extending inwardly from the crown and/or the skirt of the closure. It is preferred that the sealing ring extends inwardly from the junction of the crown and the skirt to define a ring of generally frusto-conical form.

The outer extremity of the ring on that portion adapted to engage with the neck of the container may have an annular sealing member. The annular sealing member may have a sealing surface adapted to engage the rim of the container neck and said sealing surface may carry one or more ribs each adapted to make line contact with the neck of the container.

The means for permitting the pressure of the contents to act upon the sealing ring may comprise one or more interruptions of the ring support to permit pressure to enter behind the ring and the support to urge, when applied to a container, said ring into sealing engagement with the neck thereof.

A sealing surface may be provided on the internal surface of the skirt and may gradually decrease in diameter in a direction towards the crown. The decrease in diameter is preferably progressive, that is to say, non-regular so that the sealing surface passes about a corner defined by either the junction of the disc and the skirt or the projection of the annular sealing ring in a smooth configuration, and extends inwardly of the internal generally cylindrical surface of the skirt to engage with the rim of the neck of the container to which the closure is adapted to be applied.

The closure is preferably formed of a resilient plastic material and the retaining means may be a screw thread on the internal surface of the skirt adapted to cooperate with a corresponding thread provided on the external surface of the container neck. The external surface of the skirt may be provided with a knurled portion to assist gripping and manipulation of the closure.

In use, application of the closure to the neck of the container results in engagement between the threads on the skirt and the container neck, so that rotation of the closure relative to the container neck progressively draws the closure on to the container neck. Continued application of the closure to the container neck brings the rim of the container initially into contact with the sealing surface of the closure and while at the same time urging the rim of the container neck onto the sealing surface to deform the sealing surface and effect a seal between the surface and the rim itself. Completion of the application of the closure to the container occurs when the sealing ring abutting with the annular rim of the container neck has flexed to bring the sealing surface into engagement with the rim until the side of the sealing ring opposite the sealing surface abuts the ring support. The ring support serves to urge the sealing surface into further sealing engagement with the container rim, thus providing a second seal for the closure.

The pressure generated within the container by the contents may pass between interruptions in the sealing ring support into the substantially annular cavity formed between the crown of the closure, the ring support and the flexed sealing ring itself to act upon the sealing ring to urge the same into further sealing engagement with the container to which it is applied.

Thus, in accordance with the present invention the higher the pressure of the contents, the more effective the sealing of the sealing ring, while an interference fit seal is obtained between the sealing surface and the neck of the container.

Following is a description by way of example only and with reference to the accompanying drawings of an embodiment of the closure in accordance with the present invention.

Figure 1:
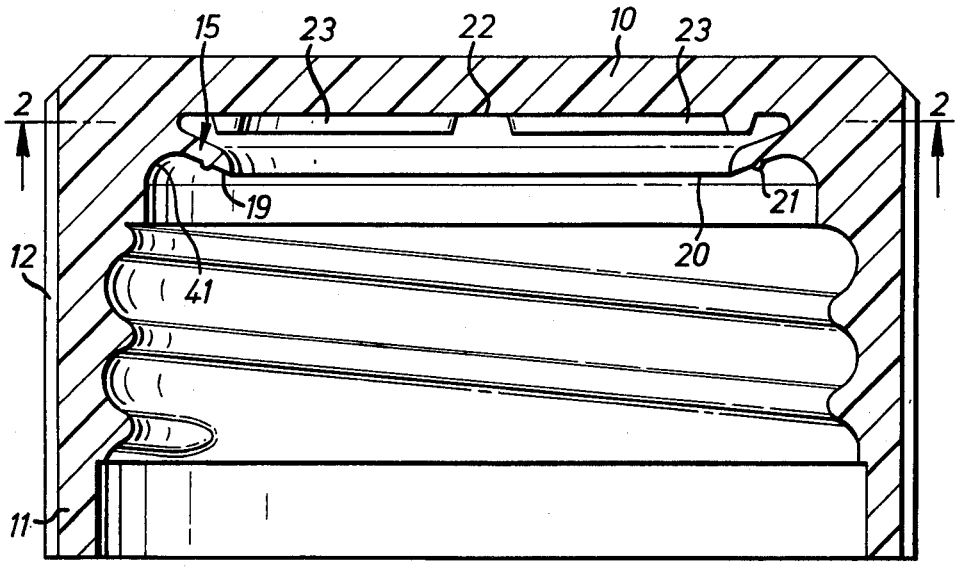
FIG. 1 is a section of a closure in accordance with the present invention.
Figure 3:
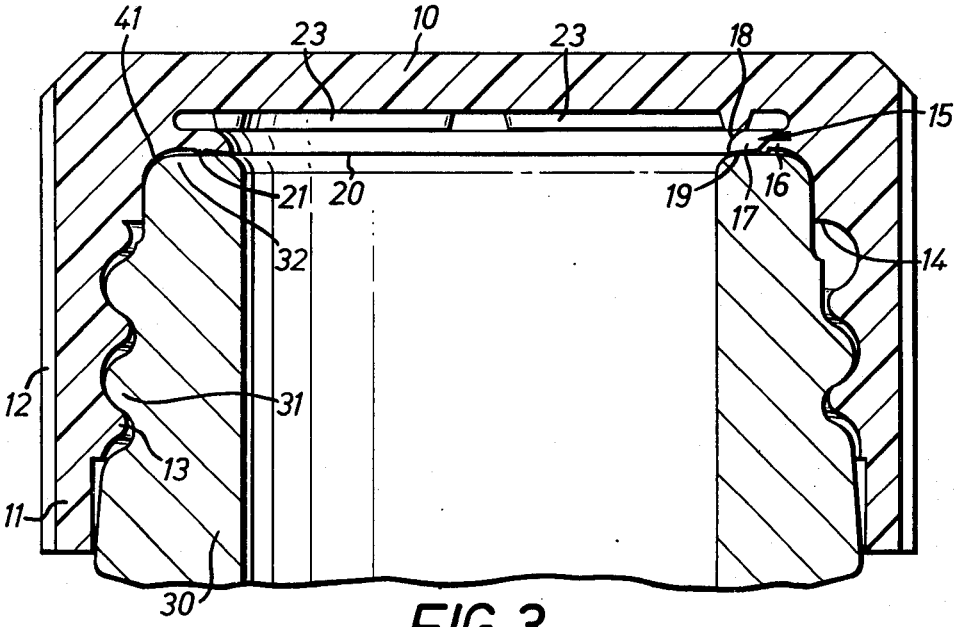
FIG. 3 is a section along the lines 3—3 of FIG. 2 showing the closure on the neck of the container in sealing engagement therewith.
Figure 2:
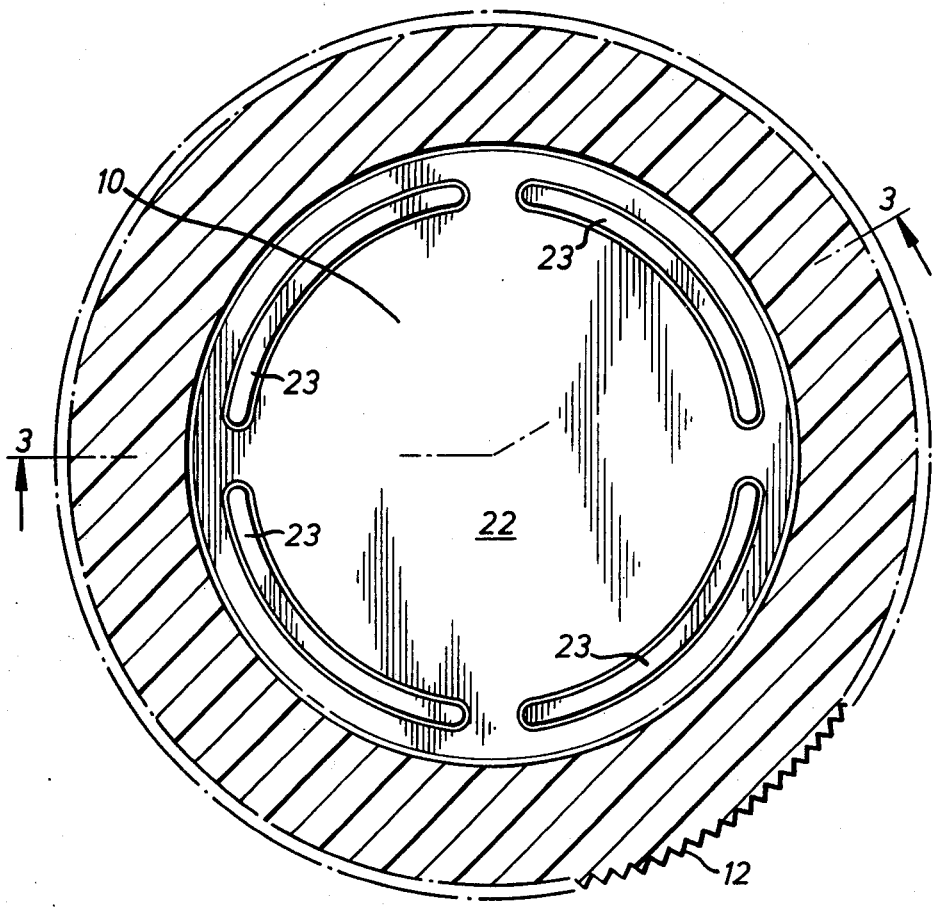
FIG. 2 is a section along the lines 2—2 of the closure of FIG. 1.

The closure comprises a substantially cylindrical disc 10 constituting a crown of the closure. The periphery of the disc 10 is provided with a depending skirt 11 which is knurled on its outer surface 12 for ready engagement and ease of gripping by the fingers.

The internal surface of cylindrical skirt 12 is provided with screw threads 13. The junction on the internal surface 14 between the disc 10 constituting a crown and the skirt 11 is provided with a generally frusto-conical inwardly directed flexible sealing ring 15. The ring 15 juxtaposed the junction 14 comprises a first flexible portion 16 and an outer sealing member 17 of greater sectional thickness than flexible portion 16. The sealing member 17 has an upper curved surface 18 and a lower sealing surface 19 which together define an annular extremity 20. The surface 19 carries three radially spaced circumferential ribs 21.

The crown of the closure constituted by disc 10 carries on its internal surface 22 a plurality of circumferentially spaced arcuate supports 23 constituting a ring support, the supports 23 extending over the greater part of the circumference of the inner surface of disc 10 and juxtaposed surface 18 of sealing ring 15.

Towards the junction of the sealing member 17 with the internal surface 14 of depending skirt 11, there is provided a resilient sealing surface 41 which extends smoothly upwardly and progressively decreases in cross sectional area to constitute part of the lower surface of flexible sealing ring 15. The sealing surface 41 is dimensioned to be an interference fit with the radially outer portion of the rim 32 and cooperates with sealing ring 15 in providing a pressure seal between the container and closure fitted thereon. The diameter of the sealing surface 41 decreases gradually across the skirt in a direction towards the crown and the decrease in diameter is progressive, that is to say, non-regular so that the sealing surface passes about the corner defined by the junction of the lower surface of the sealing ring and the skirt in a smooth configuration.

In use, the closure is applied to the neck of the container 30 by engaging the screw thread 13 on the internal surface of the skirt 11 with corresponding threads 31 on the neck 30 of the container. By screwing the closure onto the neck 30 the extremity 20 of the sealing member 17 is brought into contact with the rim 32 defining the extremity of the container neck 30. Continued application of the closures results in flexing of flexible portion 16 of sealing ring 15 to bring sealing surface 19 into juxtaposition with rim 32 so that annular rings 21 are in sealing engagement therewith, the sealing member 17 being urged into further sealing engagement by surface 18 abutting and contacting supports 23.

At the same time, the outer edge of rim of the container neck 30 engages the resilient sealing surface 41 and continued application of the closure causes the surface 41 to form an interference fit with the edge of the rim to effect a further seal.

In this condition the generation of pressure within the container itself results in an increasing pressure within the container. The interruptions or spacings between the supports 23 permit pressurized material to enter the annular space defined between supports 23 and sealing member 17 to urge the sealing member further into sealing engagement with the rim of the container. It will be appreciated that the flexible portion 16 of the sealing ring is urged and flexed into the relatively low pressure area defined between the outer surface of the rim of the container, and the inner surface of the skirt carrying threads 13.

The closure described above was attached to a test rig comprising a neck and applied with a torque of 20 lb. inches. Pressure of 160 lb. per square inch was applied to the inside of the container neck and was maintained for two minutes. The removal torque after release of pressure was 11–12 lbs. inches.

A container was filled with a standard carbonized water and the above closure applied with a torque of 20 inch lbs. The container was shaken continuously for 14 days. The container referred to above was then stored lying on its side for 80 days.

In each case, there was not leakage.

The closure may be made of any suitable resilient thermoplastic material and, depending upon the contents of the container, materials such as polypropylene and modified polyethylene have been found to be successful.

The closures manufactured in accordance with the present invention have been tested with water under laboratory conditions at pressures in excess of 50 lbs. per square inch without leaking. It will be appreciated, however, that the degree of pressure seal obtained is dependent uon the nature of the plastic employed, the nature of the contents of the container and the material and uniformity of the sealing surfaces of the container itself.

Furthermore, the closures in accordance with the present invention permit the formation of their one piece pressure resistant closure from plastic materials without the use of a separate sealing wad.

The free end of the closure skirt may carry an annular tear-strip which is dimensioned to embrace a portion of the container neck 30. The arrangement is such that cooperation between the neck 30 and the tear-strip impedes unauthorised separation of the closure and container until the tear-strip has been detached from the skirt.

What we claim is:

1. A closure cap in combination with a container which has a neck provided with a dispensing opening, said cap comprising a crown and an annular skirt depending from the crown, means on the skirt securing the cap to the container neck with the crown disposed across said opening, a flexible annular sealing ring integral with the cap and inclined inwardly towards the axis of the cap, said ring having an annular extremity in sealing contact with the top of said container around said opening, and a segmented support ring disposed on the crown within the space between the sealing ring and the inner surface of the crown whereby the sealing ring is pressed thereagainst when the sealing ring engages the container, said segmented ring permitting fluid under pressure to escape from the container into the space between the sealing ring and the crown where it is confined and urges the sealing ring against the container.

2. The combination of claim 1 further characterized by an annular resilient sealing surface on the internal surface of the skirt juxtaposed to the sealing ring, which sealing surface is adapted to be an interference fit with the neck of the container in order to effect a seal between said cap and the container neck.

3. The combination of claim 2 characterized in that the sealing surface is provided on the internal surface of the skirt and gradually decreases in diameter across the skirt in a direction towards the crown of the cap.

4. The combination of claim 3 characterized in that the decrease in diameter is progressive so that the sealing surface passes about the corner defined by the junction of the sealing ring and the skirt in a smooth configuration to extend inwardly of the cylindrical surface of the skirt.

5. The combination of claim 1 further characterized in that the outer extremity of the sealing ring has an enlarged annular member adapted to engage and seal with the neck of the container, said sealing member having a sealing surface which carries at least one rib adapted to make line contact with the neck of the container abutting said sealing surface to effect a seal therebetween.

6. The combination of claim 1 further comprising an opening in said support ring for permitting the pressure of the contents to act upon the sealing ring, said opening in said support ring comprising an interruption of the support ring to permit pressure to enter behind the sealing ring and support ring to urge, said sealing ring into sealing engagement with the container neck.

* * * * *